US005657569A

United States Patent [19]

Jernigan et al.

[11] Patent Number: 5,657,569

[45] Date of Patent: Aug. 19, 1997

[54] NIPPLE FOR MUZZLE LOADING FIREARMS

[75] Inventors: Randall D. Jernigan, Suwanee, Ga.; Francis J. Korhonen, Negaunee, Mich.

[73] Assignee: Connecticut Valley Arms, Inc., Norcross, Ga.

[21] Appl. No.: 509,162

[22] Filed: Jul. 31, 1995

[51] Int. Cl.[6] ..... F41A 17/00

[52] U.S. Cl. ..... 42/83; 42/51

[58] Field of Search ..... 42/83, 51

[56] References Cited

U.S. PATENT DOCUMENTS

| | | | |
|---|---|---|---|
| 4,065,866 | 1/1978 | Equizabal | 42/51 |
| 4,123,867 | 11/1978 | Peterson | 42/83 |
| 4,163,335 | 8/1979 | Ives | 42/83 |
| 4,186,506 | 2/1980 | Pawlak et al. | 42/83 |
| 4,461,109 | 7/1984 | Eguizabal | 42/51 |
| 4,519,157 | 5/1985 | Giangerelli | 42/83 |
| 5,016,379 | 5/1991 | Lambert | 42/83 |
| 5,467,551 | 11/1995 | Kruse | 42/83 |

*Primary Examiner*—Charles T. Jordan
*Assistant Examiner*—Meena Chelliah
*Attorney, Agent, or Firm*—Pepe & Hazard

[57] ABSTRACT

A nipple for use in igniting a propellant charge in a muzzle loading firearm employing percussive ignition caps, has an elongated body with a generally cylindrical cap receiving portion adjacent one end and a mounting portion adjacent the other end. The outer surface of the cap receiving portion is cooperatively dimensioned and configured to slidably seat percussion caps thereon. The body has a passage extending axially therethrough with a generally funnel shaped inlet portion extending axially from the one end through a major portion of the length of the body. The funnel shaped inlet portion tapers radially inwardly from the one end towards the other end at an angle less than 25° relative to the longitudinal axis of the passage, and the throat portion has a generally uniform cross section corresponding to the smallest cross section of the inlet portion.

7 Claims, 2 Drawing Sheets

NIPPLE FOR MUZZLE LOADING FIREARMS

BACKGROUND OF THE INVENTION

This invention relates to muzzle loading firearms, and, more particularly, to a nipple for muzzle loading firearms which employ percussion locks to ignite a propellant charge.

The basic elements of a percussion lock have been known for many years and include a spring loaded hammer, a percussion cap, and a nipple communicating with the powder in the firing chamber of the firearm through a bolster. The percussion cap containing explosive fulminate is placed over the end of the nipple. To fire the gun, the spring loaded hammer is released and strikes the cap, crushing it and detonating the fulminate inside. The resulting "flame" from the fulminate is a combination of burning gases and particulate sparks under high pressure, and this flame is conducted through a passage in the nipple and bolster into the firing chamber in the firearm, to ignite the powder charge.

In addition to conducting a sufficient flame from the cap to the powder charge, it is desirable that nipples limit flow of flame and gases exiting the firearm after ignition of the powder charge. If the flow of gases exiting the firearm is of great enough intensity and force, it may blow the ignition hammer backwards. This occurrence is referred to as "blow-back", and is generally undesirable because of the danger it represents to the user and the shock force load it applies to the hammer and its spring mechanism which may cause premature degradation of the hammer and spring.

Conventional nipples are designed to conduct enough of the ignition flame and sparks to light the main powder charge, yet limit the amount of flame and gases escaping from the firearm after ignition to minimize the occurrence of "blow-back". The conventional nipple geometry has a drilled passage therethrough with a primary, relatively large diameter cylindrical chamber at the cap receiving end of the nipple and a shorter, relatively small diameter throat or constricted chamber adjacent the mounting end of the nipple. The junction of the two chambers represents a sudden constriction in the flow passage.

More recently, there has been proposed a nipple employing a passage having a large diameter cylindrical inlet section which in turn communicates with an intermediate conical section which communicates with a small diameter cylindrical throat section. The portion of the inlet and throat sections adjacent the nipple ends are untapered to reduce "blow-back" from the firearm and simplify nipple construction. This type of nipple is illustrated in Pawlak U.S. Pat. No. 4,186,506.

Although the Pawlak nipple offers many advantages over prior art devices, this nipple geometry still provides a relatively sharp constriction in the overall flow passage which tends to limit the amount of ignition flame conducted to the main powder charge. This, in turn, decreases the reliability of ignition of the main powder charge and may prolong the time required to light the main powder charge.

Accordingly, it is an object of the present invention to provide a novel nipple for a muzzle loading firearm which maximizes the amount of ignition gas and sparks conducted to the main powder charge to enhance the reliability of ignition of the main powder charge.

It is also an object to provide such a nipple which reduces the time required for the ignition flame to light the main powder charge.

Another object is to provide such a nipple which limits the amount of gases and flame escaping through the nipple from the firearm.

Still another object is to provide such a nipple which may be fabricated relatively easily and economically and which is long lasting.

SUMMARY OF THE INVENTION

It has now been found that the foregoing and related object may be readily attained in a novel nipple for use in igniting a powder charge in a muzzle loading firearm of the type employing percussive ignition caps. The nipple has an elongated body with a generally cylindrical cap receiving portion adjacent one end and a mounting portion adjacent the other end. The outer surface of the cap receiving portion is cooperatively dimensioned and configured to slidably seat percussion caps thereon and the body has a passage extending axially therethrough. The passage has a generally funnel shaped inlet portion extending axially from the one end through a major portion of the length of the body, and a generally cylindrical throat portion extending axially through a minor portion of the length of the body from the other end to the inlet portion. The funnel shaped inlet portion tapers radially inwardly from the one end towards the other end at an angle less than 25° relative to the longitudinal axis of the passage, and the throat portion has a generally uniform cross section corresponding to the smallest cross section of the inlet portion.

Preferably, the ratio of the length of the inlet portion of the passage to the throat portion of the passage is approximately 3:1, and the ratio of the diameter of the inlet portion of the passage at the one end to the diameter of the throat portion of the passage is approximately 3:1.

Generally, the mounting portion of the body has external threads thereon, and the body also has an intermediate portion between the cap receiving and mounting portions with at least two flat surfaces about its periphery to seat a tool for rotation of the nipple.

DETAILED DESCRIPTION OF THE PREFERRED EMBODIMENT

Figure 1:
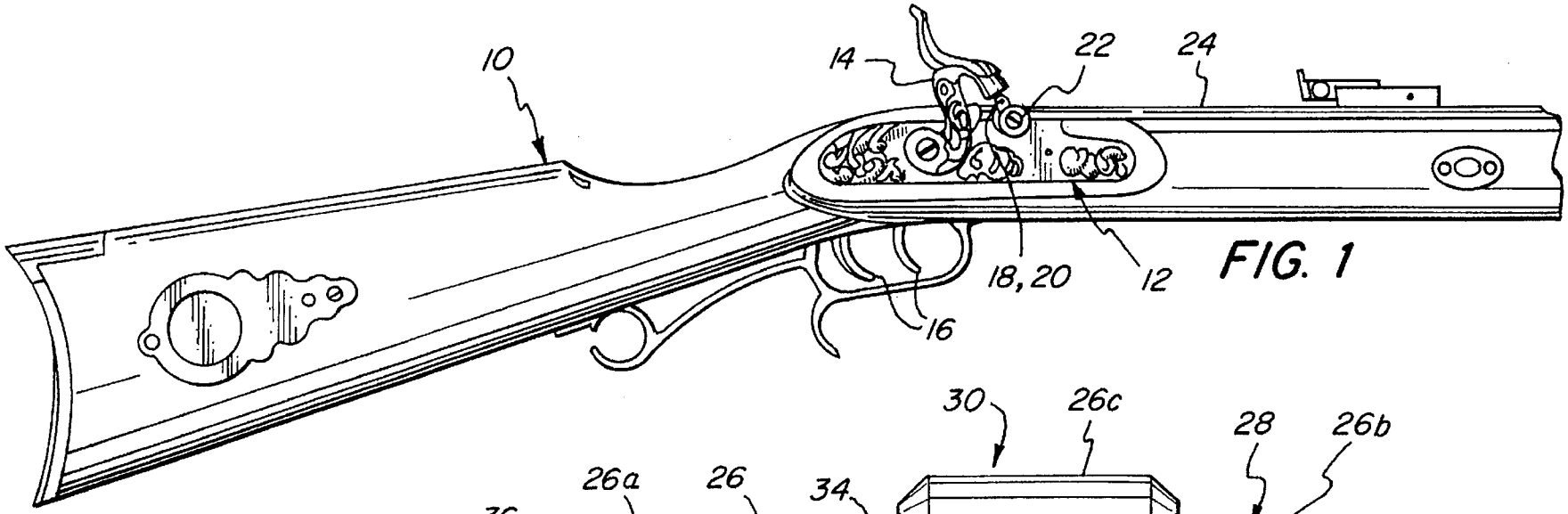
FIG. 1 is a fragmentary side elevational view of a muzzle loading firearm incorporating the nipple of the present invention.
Figure 2:
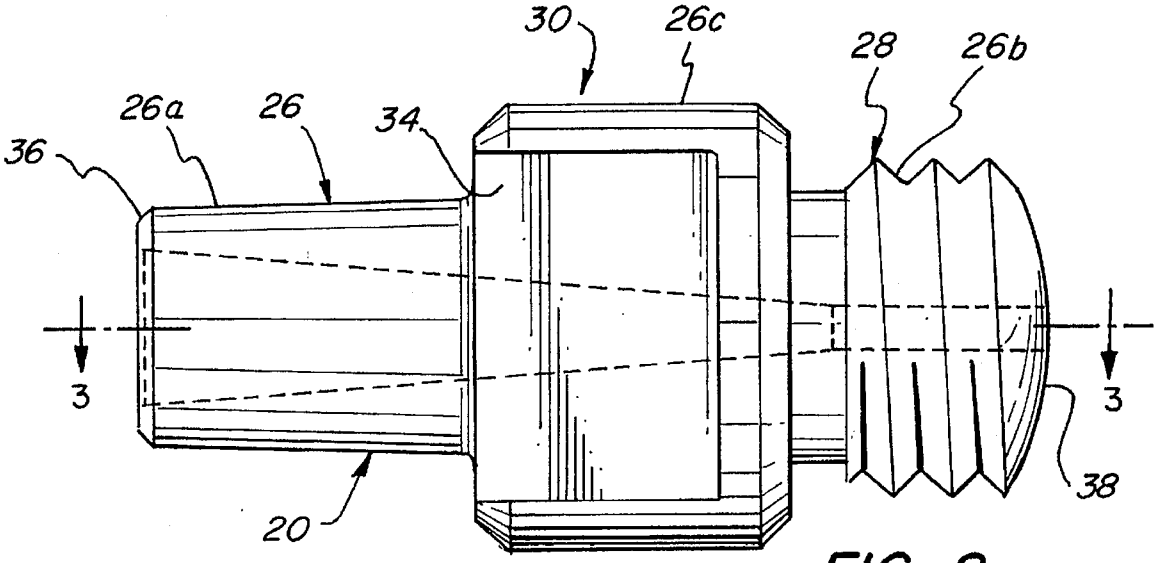
FIG. 2 is a side elevational view of the nipple of the present invention drawn to a enlarged scale.
Figure 3:
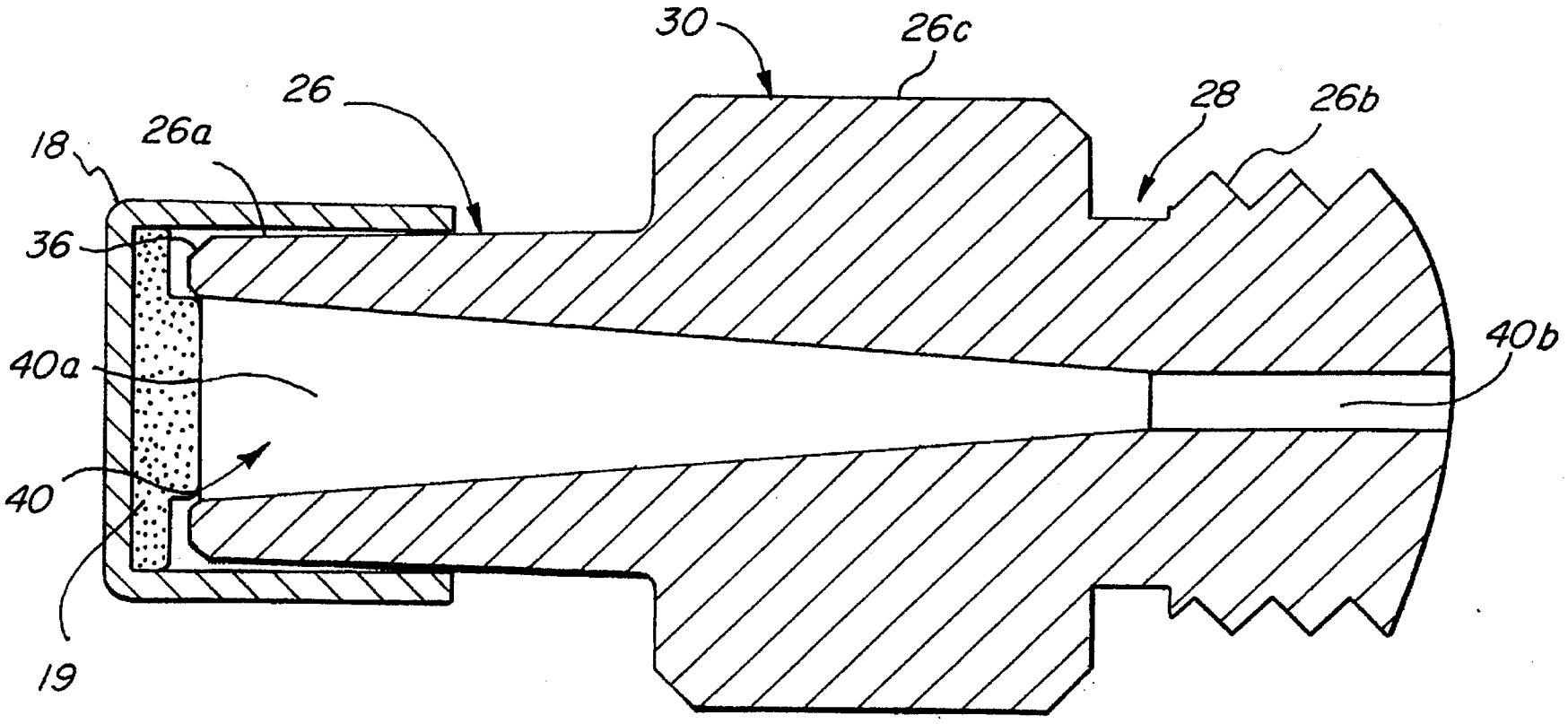
FIG. 3 is a sectional view along the line 3—3 of FIG. 2 and showing a percussion cap seated thereon.

Turning first to FIG. 1, therein fragmentarily illustrated is a muzzle loading firearm having a gun barrel 10, a stock 8, and a percussion lock firing assembly generally designated by the numeral 12 to ignite a powder charge (not shown) within the firing chamber (not shown) at the inner end of the gun barrel 10. The percussion lock firing assembly 12 includes a spring loaded hammer 14 which is actuated by the triggers 16, and a bolster 22 upon which is mounted a nipple embodying the present invention and generally designated by the numeral 20. The nipple 20 communicates through the bolster 22 with the firing chamber (not shown) at the inner end of the gun barrel 24, and the nipple 20 has a percussion cap 18 slidably seated thereon as seen in FIG. 3.

Turning in detail to the nipple 20, it is elongated and has generally cylindrical end portions 26, 28 and an intermediate collar portion 30 of enlarged cross section. The end portion 26 has a chamfered end 36 and is dimensioned and configured to slidably seat the cylindrical body portion of the percussion cap 18. The end portion 28 has a convex end 38 and has external threads to threadably seat in the bolster 22. The intermediate collar portion 30 is generally cylindrical but has two opposed, parallel flat surfaces 34 by which the nipple 20 may be gripped and rotated into and out of the bolster 22 by a wrench (not shown).

As is conventional in percussion lock firing systems, the nipple 20 conducts the ignition sparks and hot gases released by the detonation of the charge 19 in the percussion cap 18 to the bolster 22, which in turn conducts the sparks and hot gases into the firing chamber in the firearm 10 to ignite the main propellant charge (not shown) in the firing chamber. To accomplish this, a passage 40 extends longitudinally through the nipple 20 and includes a funnel-shaped or frustoconical inlet portion 40*a* or "flash chamber" which tapers into a cylindrical outlet portion 40*b* or "throat".

The wall defining the funnel-shaped inlet portion 40*a* of the passage 40 tapers at an angle of approximately 10° to the axis of the passage, and it extends substantially through the nipple the sections 26 and 30. The cylindrical outlet portion 40*b* extends substantially through the nipple section 26 and has a diameter corresponding to the inner or small end of the inlet portion 40*a*. The ratio of the length of the inlet portion 40*a* to the outer portion 40*b* of the passage is approximately 3:1. Similarly, the ratio of the diameter of the inlet portion 40*a* adjacent the inlet end 36 to the diameter of the outlet portion 40*b* of the passage is about 3:1.

In operation, the threaded mounting portion 28 of the nipple 20 is threadably seated in the bolster 22 and a percussion cap 18 is placed on the cap receiving portion 26 of the nipple 20. The cap 18 contains an explosive fulminate charge 19 disposed adjacent the inlet portion 40*a* of the passage 40 in the nipple 20.

To fire the gun, the spring loaded hammer 14 is released by triggers 16, and strikes the cap 18, crushing it and igniting the fulminate charge 19. The sparks and hot gases from the ignited fulminate are directed through the inlet portion 40*a* and the throat portion 40*b* of the passage 40, out of the end 38 of the nipple 20 and into a passage (not shown) in the bolster 22 which communicates with the firing chamber of the firearm. The high velocity, high pressure, and high temperature gases and sparks or flame ignite the main propellant charge in the firing chamber.

Although the constriction of the reduced diameter throat section 40*b* serves the function of reducing the "blow back" which might result from the ignition of the main propellant charge, it could also reduce the ability of the passage 40 to conduct the ignition gases and sparks from the percussion cap 18. The funnel-shaped inlet portion 40*a* gradually channels the ignition sparks or flame and gases to the constricted throat portion 40*b*. The more gradual the reduction in cross section of the passage 40, the less resistance it provides to the flow of the ignition gases and flames or sparks. Thus, the funnel-shaped inlet passage 40*a* of the nipple 20 of the present invention provides substantially less resistance to the flow of the hot gases and sparks or flame than a cylindrical passage of a similar volume with a more sudden constriction and it smoothly channels the flow into the constricted throat portion.

The size of the internal angle between the wall of the inlet portion and the passage axis and the relative size of the inlet portion 40*a* and outlet portion 40*b* of the passage 40 have been determined empirically as the optimum design tradeoff between ignition gas conductance in the passage 40 and the ability to retard blow-back.

As will be appreciated, the passage 40 of the nipple 20 performs the function of a nozzle, through which hot gas is accelerated and directed into a narrower, higher velocity stream. As a result, the hot gas and flame or sparks will travel therethrough at a higher velocity and for a further distance. This greatly increases the amount of hot gases and sparks or flame travelling through the bolster to the firing chamber and increase the reliability of ignition of the main propellant charge.

Although various materials may be employed for the construction of the nipple, it is preferably machined from hardened stainless steel for maximum dimensional stability and long life.

Thus, it can be seen from the foregoing detailed description and attached drawings that the nipple of the present invention significantly enhances the ability of the nipple to conduct ignition gases and sparks or flame while reducing blow-back.

Having thus described the invention, what is claimed is:

1. A nipple for use in igniting a propellant charge in an associated muzzle loading firearm of the type employing percussive ignition caps, said nipple having:

(a) an elongated body having a generally cylindrical cap receiving portion adjacent one end and a mounting portion adjacent the other end, the outer surface of said cap receiving portion being cooperatively dimensioned and configured to slidably seat percussion caps thereon and said body having a passage extending axially therethrough with an inlet portion extending axially from said one end through a major portion of the length of said body, said inlet portion being generally funnel shaped for its entire length, and a generally cylindrical throat portion extending axially through a minor portion of the length of said body from said other end to said inlet portion, said funnel shaped inlet portion tapering radially inwardly from said one end towards said other end at an angle of less than 25° relative to the longitudinal axis of said passage, said throat portion having a generally uniform cross section corresponding to the smallest cross section of said inlet portion.

2. A nipple according to claim 1 wherein the ratio of the length of the inlet portion of said passage to the throat portion of said passage is about 3:1.

3. A nipple according to claim 1 wherein the ratio of the diameter of said inlet portion of said passage at said one end to the diameter of said throat portion of said passage is about 3:1.

4. A nipple according to claim 1 wherein said mounting portion of said body has external threads thereon, said body also having an intermediate portion between said cap receiving and mounting portions with at least two flat surfaces about its periphery to seat a tool for rotation of said nipple.

5. In combination;

(a) a muzzle loading firearm having a bolster and a hammer; and (b) a nipple on said bolster for use in igniting a propellant charge in said muzzle loading firearm and adapted to seat on its outer end a percussive ignition cap, said nipple having:

(i) an elongated body having a generally cylindrical cap receiving portion adjacent one end and a mounting portion adjacent the other end engaged with said bolster, the outer surface of said cap receiving portion being cooperatively dimensioned and configured to slidably seat percussion caps thereon and said body having a passage extending axially therethrough with an inlet portion extending axially from said one end through a major portion of the length of said body, said inlet portion being generally funnel shaped for its entire length, and having a generally cylindrical throat portion extending axially through a minor portion of the length of said body from said other end to said inlet portion, said funnel shaped inlet portion tapering radially inwardly from said one end towards said other end at an angle less than 25° relative to the longitudinal axis of said passage, said throat portion having a generally uniform cross section corresponding to the smallest cross section of said inlet portion.

6. The muzzle loading firearm in accordance with claim 5 wherein said mounting portion of said body has external threads thereon threadably engaged in a threaded recess in said bolster, said body also having an intermediate portion adjacent said threaded portion with at least two flat surfaces about its circumference to seat a tool for rotation of said nipple.

7. The muzzle loading firearm in accordance with claim 5 wherein the ratio of the length of the inlet portion of said passage to the throat portion of said passage is approximately 3:1, and wherein the ratio of the diameter of said inlet portion of said passage at said one end to the diameter of said throat portion of said passage is approximately 3:1.

* * * * *